US005609046A

United States Patent [19]

Fleissner

[11] Patent Number: 5,609,046

[45] Date of Patent: Mar. 11, 1997

[54] DEVICE FOR CONTINUOUS TREATMENT OF TEXTILE MATERIAL OR THE LIKE

[75] Inventor: Gerold Fleissner, Zug, Switzerland

[73] Assignee: Fleissner GmbH & Co., KG, Egelsbach, Germany

[21] Appl. No.: 493,321

[22] Filed: Jun. 21, 1995

[30] Foreign Application Priority Data

Jun. 28, 1994 [DE] Germany ..... 44 22 508.3

[51] Int. Cl.[6] ..... D06B 5/08

[52] U.S. Cl. ..... 68/5 D; 15/307; 34/122; 68/903

[58] Field of Search ..... 68/903, 5 D, 5 E, 68/158, 184; 34/115, 122; 15/307

[56] References Cited

U.S. PATENT DOCUMENTS

| | | | |
|---|---|---|---|
| 776,197 | 11/1904 | Nistle | 34/115 X |
| 2,753,181 | 7/1956 | Anander | 15/307 X |
| 3,604,223 | 9/1971 | Packshies et al. | 15/307 X |

FOREIGN PATENT DOCUMENTS

| | | | |
|---|---|---|---|
| 1886883 | 12/1963 | Germany . | |
| 2355231 | 5/1975 | Germany | 34/115 |
| 834638 | of 1906 | United Kingdom | 34/115 |

*Primary Examiner*—Philip R. Coe
*Attorney, Agent, or Firm*—Antonelli, Terry, Stout & Kraus, LLP

[57] ABSTRACT

A device for continuous treatment of sheet material or the the like includes a permeable drum for wet or dry treatment of textile material, paper or other permeably materials of a certain width having a normal perforated sheet metal drum jacket, upon which sheet metal strips extending longitudinally over the length of the drum are welded at a spacing from one another. The sheet metal strips improve the uniform ventilation of the material lying externally on the a screen mesh covering on the edges of the sheet metal strips and in addition increase the resistance of the drum to bulging.

9 Claims, 2 Drawing Sheets

DEVICE FOR CONTINUOUS TREATMENT OF TEXTILE MATERIAL OR THE LIKE

FIELD OF THE INVENTION

This invention relates to a device for continuous treatment of textile material, fleeces or paper with a gaseous or liquid treatment fluid or medium circulated therein, the device having as a transport member, a permeable sheet metal drum jacket under a suction draft with bases at its ends and covered on its periphery with a screen-like covering; there being present between the screen-like covering and the drum jacket, support means for increasing the distance between the drum jacket and the covering.

BACKGROUND OF THE INVENTION

A device of this type is known from DE-GM 1 886 883. In this document, there is merely proposed as a support only a screen mesh with a coarser wire diameter. This drum covering has the advantage that the perforated drum, or more precisely the material lying thereon, can be more uniformly ventilated than in the case of a simple perforated sheet metal drum. The material for treatment, because of the additional screen mesh, lies at a larger distance from the drum jacket, so that no dead areas, and no areas which are not infiltrated with treatment medium occur over the surface of the material being treated.

It has become apparent in practice, that particularly in the case of extreme drum lengths and even with small drum diameters, the surface stresses arising on the drum, also depending on the density of the material to be treated, have an effect on the precision of rotation of the drum. Irrespective of whether a screen mesh is used or not, or whether a double screen mesh is used, during operation of the drum, the drum metal bulges and thus reduces the previously generated precise rotation of the drum. It has been thought the screen drum with this type of sheet metal construction is not suitable because of such surface stresses.

SUMMARY OF THE INVENTION

An object of the present invention is to provide a screen drum device with a construction of the type heretofore described wherein not only is the air permeability uniformly retained over the surface of the material to be treated but, rather, it is increased and, at the same time, bulging of the drum, even under higher surfaces stresses and thus lower vacuum conditions, is prevented, so that the precision of rotation first generated is always retained.

In fulfillment of this object, support means are provided which comprise sheet metal strips that extend rectilinearly and unbent from base to base, parallel to the drum axis, and over the entire length of the drum. Thus, an additional screen mesh with coarser wires is avoided. It is essential for the stability of the drum including the drum jacket that the required vacuum for producing the suction draft not only causes spacing of the screen-like covering, but at the same time the surface stability of the sheet metal jacket is increased. This is effected optimally if the sheet metal strips are rectangular in design and heights of each substantially extends in a radial direction. There is, however, also an improvement in stability with circular sheet metal strips having a circular cross-section.

A difference is to be seen in a drum construction of this type, compared, for example, to one according to DE 39 05 738 A1. In that document, radially extending sheet metal strips are in fact provided, yet these, together with the spacers aligned transversely thereto, which are screwed to the sheet metal strips, form an inherently stable drum, i.e. a drum without a sheet metal drum jacket, which in this case provides the stability of the drum. In this case, a supporting structure is intended to be produced only by the sheet metal strips, whose intrinsic stability is only of secondary importance.

It is important for the stability of the drum that the sheet metal strips of the present invention are rigidly secured to said permeable drum, i.e. to the perforated jacket. In an advantageous development, there are to be used as the support means rectilinearly extending sheet metal strips extending parallel to the drum axis and over the entire length of the drum from base to base, the sheet metal drum jacket is to bear on the radially inwardly lying edges of the sheet metal strips directly, and these edges of the sheet metal strips are to be rigidly connected to the outer periphery of the jacket of the sheet metal drum. The radially inwardly lying edges of the sheet metal strips are to be welded to the outer periphery of the sheet metal drum jacket, preferably over its entire length. This overall construction increases the stability of the drum.

BRIEF DESCRIPTION OF THE INVENTION

An embodiment of the device according to the invention is shown in the drawing, wherein:

FIG. 1 is a longitudinal cross-section through a screen drum device, whose jacket in this case comprises perforated sheet metal drum with vertically upwardly projecting sheet metal strips mounted thereon, and further, a screen mesh arranged radially outwards of the jacket, FIG. 2 is a greatly enlarged view of a portion of the support means on the sheet metal jacket of the screen drum device in a cross-section transverse to that shown in FIG. 1, and FIGS. 3A and 3B, respectively, show a greatly enlarged view of a portion of the support means on the sheet metal jacket of the screen drum device in a cross-section transverse to that shown in FIG. 1, wherein the metal strips are, respectively, square or circular in cross-section.

DETAILED DESCRIPTION OF THE INVENTION

Figure 1:
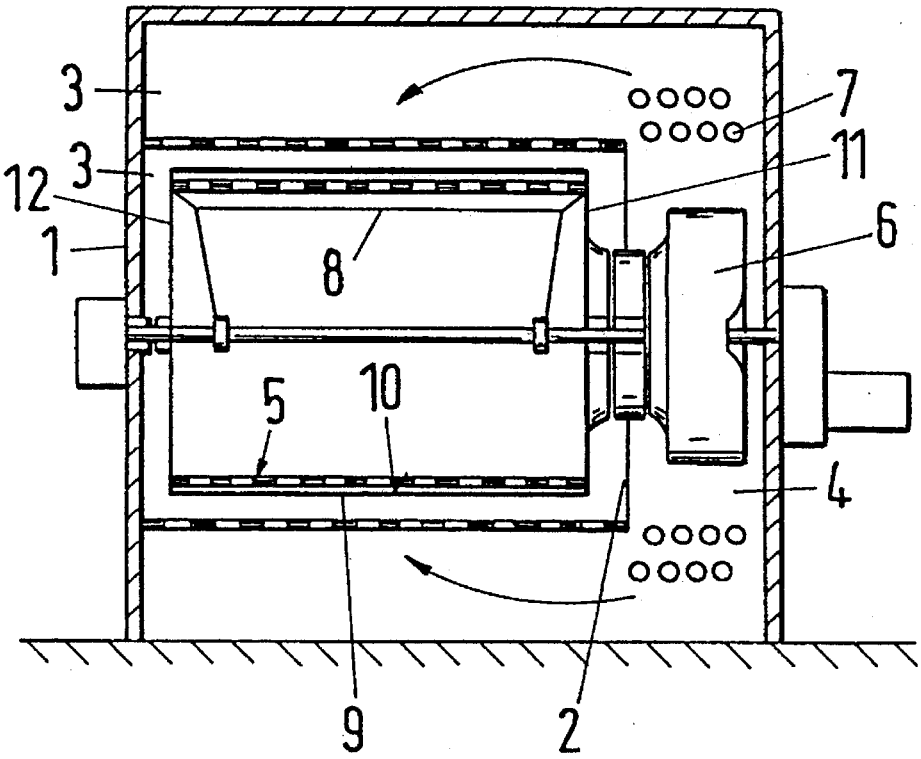

A screen drum device basically comprises a roughly rectangular housing 1, which is subdivided by a partition wall 2 into a treatment chamber 3 and a fan chamber 4. The screen drum with perforated jacket 5 is mounted to rotate in the treatment chamber 3, and concentrically arranged therein, a fan 6 is mounted to rotate in the fan chamber 4. Naturally the fan chamber may also be located in a separate blower housing separated from the screen drum housing 1 and not as shown here. In any case, the fan subjects the interior of the drum to a suction draft. The drum construction in a wet treatment device, which can also serve to extract liquid, is also part of the present invention. Such overall construction should then be considered as adapted to the present invention.

According to FIG. 1, there are located above and beneath the fan 6 respective heating units 7, which comprise tubes though which heating medium flows. The sheet metal drum jacket is covered internally in the area not covered by a textile material by an internal covering or baffle 8, to act against the suction draft. The effective jacket of the sheet metal drum is formed by a perforated sheet to be further described below, together with the sheet metal strip structure shown in FIG. 2. This is externally surrounded by a fine-mesh screen 9, which is held under tension on each end face of the drum at the two ends or bases 11, 12, for example, by tensioning rings.

Figure 2:
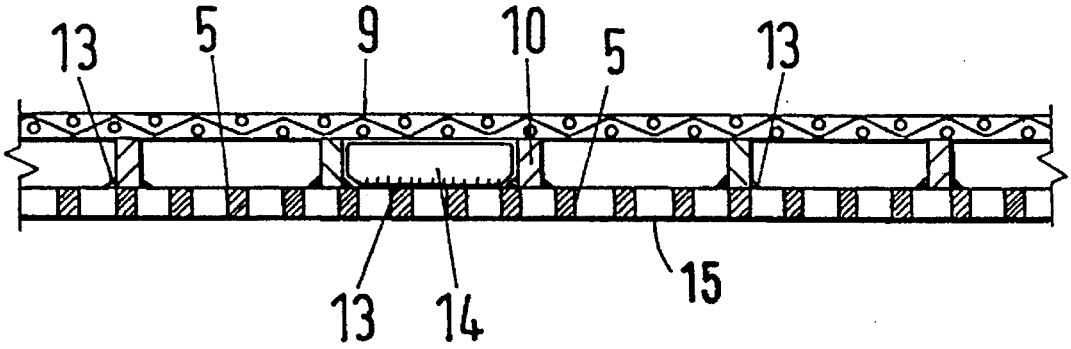
Figure 3A:
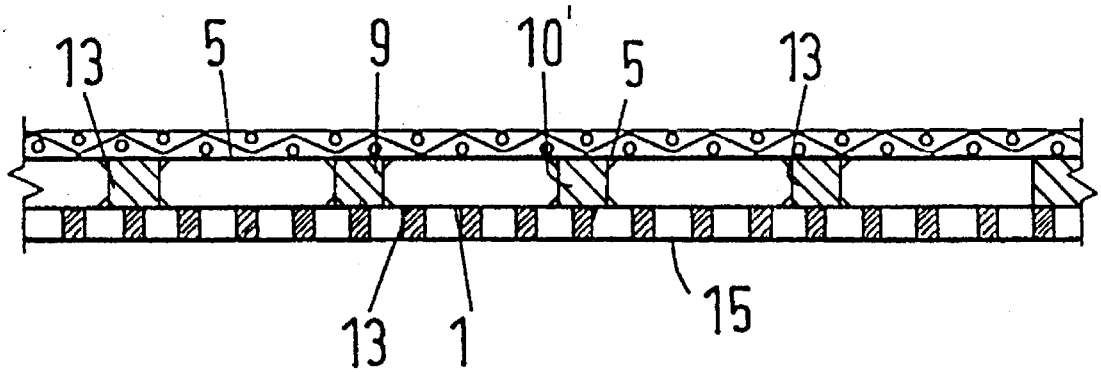
Figure 3B:
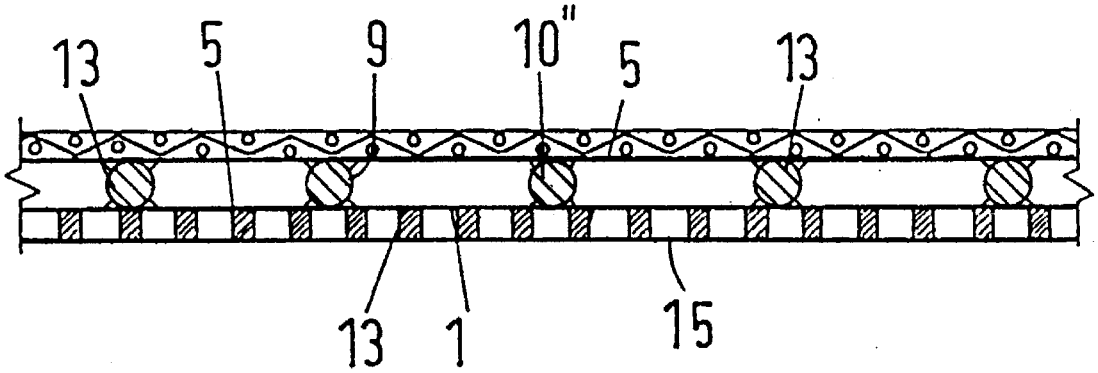

The sheet metal strip structure comprises axially aligned sheet metal strips 10, whose radially aligned heights are apparent from FIG. 2. The sheet metal strips may also have a different cross-section; the strips may be square or also round, i.e. circular see FIG. 3A and 3B. The best results as regards resistance to bulging of the structure are, however, achieved with the rectangular cross-section shown. Thus, the screen-like covering 9 bears only on the radially outwardly located edges of the sheet metal strips 10. The sheet metal strips 10 bear with their radially inwardly lying edges directly on the screen drum jacket 5, and are located at a specific spacing next to one another on the screen drum jacket 5. As shown in FIG. 2, a plurality of perforations or holes 15 are provided between the metal strips 10. In order that this spacing and the exact alignment of the sheet metal strips 10 is fixed over the width of the drum jacket, the sheet metal strips 10 are welded onto the drum jacket 5. The weld seams are designated by reference numerals 13. A weld seam 13 continuously extending over the length of the drum jacket is to be preferred to spot welding or the like.

Sheet metal strips which extend only in this direction then make possible a leakage air flow, if it is made constructively possible to adapt the drum length to the working width at any moment. In other words, if a lateral covering covers a portion of the drum length, then the air can flow through beneath the covering and through a portion of the covered drum, flowing parallel to the sheet metal strips 10 under the covering. In order to prevent this, it is appropriate to locate between the sheet metal strips 10 and transverse thereto, webs 14 which close off an air chamber. These webs are not spacers, but only partition walls preventing undesired air flow. The webs 14 should likewise be attached by weld seams to the sheet metal drum jacket 5. Only one such web 14 is shown in FIG. 2 as an example, in order to indicate that only a special construction of one portion of the drum is involved.

What is claimed is:

1. A device for continuous treatment of textile material, fleeces paper with a gaseous or liquid treatment medium circulated in the device, said device comprising, as a transport member, a permeable sheet metal drum jacket under suction draft and with bases at its ends, said jacket being surrounded on its periphery by a screen mesh covering and between the screen mesh covering and the drum jacket, a support means for increasing the distance between the drum jacket and the covering, said support means comprising sheet metal strips that extend rectilinearly and unbent from one base to the other base parallel to a longitudinal axis of the drum jacket and over an entire length of the drum jacket, said sheet metal strips having radially inward lying edges and the sheet metal drum jacket bearing directly on the radially inwardly lying edges of the sheet metal strips, said edges of the sheet metal strips being securely fixed to an external periphery of the sheet metal drum jacket, and said drum jacket having a plurality of perforations arranged between said metal strips.

2. A device according to claim 1, wherein the sheet metal strips are rectangular in cross-section and thus the heights of the strips each extends substantially in a radial direction.

3. A device according to claim 2, wherein the sheet metal strips are square in cross-section.

4. A device according to claim 1, wherein the sheet metal strips are circular in cross-section.

5. A device according to claim 1, wherein the radially inwardly lying edges of the sheet metal strips are welded to the external periphery of the sheet metal drum jacket.

6. A device according to claim 5, wherein the sheet metal strips are welded continuously over their entire lengths to the sheet metal drum jacket.

7. A device according to claim 1, wherein the screen mesh covering bears directly on radially outwardly lying edges of the sheet metal strips.

8. A device for continuous treatment of textile material, fleeces or paper with a gaseous or liquid treatment medium circulated in the device, said device comprising, as a transport member, a permeable sheet metal drum jacket under suction draft and with bases at its ends, said jacket being surrounded on its periphery by a screen mesh covering and between the screen mesh covering and the drum jacket, a support means for increasing the distance between the drum jacket and the covering, said support means comprising sheet metal strips that extend rectilinearly and unbent from one base to the other base parallel to a longitudinal axis of the drum jacket and over an entire length of the drum jacket, said drum jacket having a plurality of perforations arranged between said metal strips and there are located, entirely in order to prevent leakage air flows parallel to the sheet metal strips, in an edge region of the drum during restrictions in working width, webs arranged transverse to the sheet metal strips which likewise extend from the screen mesh covering as far as the sheet metal drum jacket and are securely connected to the sheet metal drum jacket.

9. A device according to claim 1, wherein the screen mesh covering is a cylindrical structure which extends over the entire length of the drum jacket.

* * * * *